US009518246B2

(12) United States Patent
Tachikawa et al.

(10) Patent No.: US 9,518,246 B2
(45) Date of Patent: Dec. 13, 2016

(54) CLEANERS FOR HARD SURFACES COMPRISING PHOSPHORIC ACID ESTERS OF A POLYETHER-MODIFIED ALKYL ALCOHOL

(71) Applicant: Henkel AG & Co. KGaA, Duesseldorf (DE)

(72) Inventors: Kaoru Tachikawa, Urdorf (CH); Kerstin Ziganke, Hilden (DE); Stefan Karsten, Gummersbach (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/851,069

(22) Filed: Sep. 11, 2015

(65) Prior Publication Data

US 2015/0376551 A1 Dec. 31, 2015

Related U.S. Application Data

(63) Continuation of application No. PCT/EP2014/054646, filed on Mar. 11, 2014.

(30) Foreign Application Priority Data

Mar. 15, 2013 (DE) ..... 10 2013 204 615
Mar. 19, 2013 (DE) ..... 10 2013 204 824

(51) Int. Cl.

| | |
|---|---|
| ***C11D 1/34*** | (2006.01) |
| ***C11D 1/78*** | (2006.01) |
| ***C11D 3/06*** | (2006.01) |
| ***C11D 7/36*** | (2006.01) |
| ***C11D 3/36*** | (2006.01) |
| ***C11D 11/00*** | (2006.01) |
| ***C11D 1/22*** | (2006.01) |
| ***C11D 1/66*** | (2006.01) |

(52) U.S. Cl.

CPC ..... *C11D 3/362* (2013.01); *C11D 1/22* (2013.01); *C11D 1/66* (2013.01); *C11D 11/0023* (2013.01)

(58) Field of Classification Search

CPC ..... C11D 1/34; C11D 1/345; C11D 1/78; C11D 3/06; C11D 3/362; C11D 7/36; C11D 11/0023

See application file for complete search history.

(56) References Cited

U.S. PATENT DOCUMENTS

| | | | | |
|---|---|---|---|---|
| 6,310,123 | B1 | 10/2001 | Boinowitz et al. | |
| 6,403,546 | B1 | 6/2002 | Hernandez et al. | |
| 6,423,130 | B2 | 7/2002 | Boinowitz et al. | |
| 6,689,731 | B2 * | 2/2004 | Esselborn ..... | C08G 65/327 510/276 |
| RE39,746 | E | 7/2007 | Boinowitz et al. | |
| 2006/0254460 | A1 | 11/2006 | Noerenberg et al. | |

FOREIGN PATENT DOCUMENTS

| | | | |
|---|---|---|---|
| DE | 10054462 | A1 | 6/2002 |
| WO | 92/12950 | A1 | 8/1992 |
| WO | 2013/004302 | A1 | 1/2013 |

OTHER PUBLICATIONS

PCT International Search Report (PCT/EP2014/054646) dated May 19, 2014.

* cited by examiner

*Primary Examiner* — Charles Boyer
(74) *Attorney, Agent, or Firm* — P. Scott Smith

(57) ABSTRACT

The present invention relates to cleaners for hard surfaces which comprise surfactants and also phosphoric acid esters of a polyether-modified alkyl alcohol, and to the method of use thereof for cleaning hard surfaces and for generating shine on a hard surface.

15 Claims, No Drawings

CLEANERS FOR HARD SURFACES COMPRISING PHOSPHORIC ACID ESTERS OF A POLYETHER-MODIFIED ALKYL ALCOHOL

FIELD OF THE INVENTION

The present invention generally relates to cleaners for hard surfaces which comprise surfactants and phosphoric acid esters of a polyether-modified alkyl alcohol, and to the use thereof for cleaning hard surfaces and for generating shine on a hard surface.

BACKGROUND OF THE INVENTION

Conventional shine additives for cleaning formulations for hard surfaces are based on added wax or acrylic polymer, which do not support a cleaning function. Such care products, which generate shine and at the same time have a repair effect, are often provided as wax-like compositions and in order to attain a shine and repair effect require application and subsequent, possibly repeated, polishing. Such agents leave behind a solid film, which seals the surface. In particular on floor coverings, such compositions may lead to visible tread marks due to different mechanical loading. Uneven surfaces are smoothed as a result of this, and although shine is generated, the property of the surface is also changed visibly. In most cases even matte or structured surfaces treated in this way appear varnished and do not look refreshed and new. Currently obtainable formulations are expensive and the ingredients often are not soluble in water.

BRIEF SUMMARY OF THE INVENTION

In order to simplify the application, it would be desirable to provide additives for normal all-purpose cleaners that have a shine and repair effect on hard surfaces, such as ceramic, porcelain, stone, glass and laminate, even at low concentrations without polishing, and do not leave behind any stripes or tacky surfaces.

Furthermore, other desirable features and characteristics of the present invention will become apparent from the subsequent detailed description of the invention and the appended claims, taken in conjunction with the accompanying drawings and this background of the invention.

A cleaner for hard surfaces comprising at least one surfactant and 0.1 to 3% by weight of at least one phosphoric acid ester of a polyether-modified alkyl alcohol or salt thereof, characterized in that the phosphoric acid ester of a polyether-modified alkyl alcohol has the general formula 1:

Formula 1

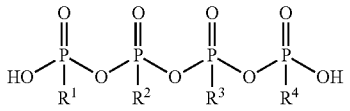

wherein $R^1$, $R^2$, $R^3$ and $R^4$ may be the same or different and are selected from R—O—$(SO)_m$-$(EO)_b$—$(PO)_c$—$(BO)_d$— and —OH, wherein.

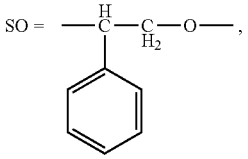

EO=—$CH_2$—$CH_2$—O—

PO=—$CH(CH_3)$—$CH_2$—O— and

BO=—$CH(CH_2CH_3)$—$CH_2$—O— and with the provision that at least one, preferably at least 2, in particular 3, particularly preferably 4, of the groups $R^1$, $R^2$, $R^3$ and $R^4$ are not OH, wherein a=1 to 20, preferably 2.2 to 10, more preferably 2.5 to 7, particularly preferably 3 to 5; b=1 to 100, preferably 3 to 40, more preferably 4 to 15, particularly preferably 8 to 12; c=0 to 10, in particular 0; d=0 to 10, in particular 0; and R is selected from branched or linear, saturated or unsaturated alkyl groups containing 8 to 10 carbon atoms, preferably linear, saturated alkyl groups containing 8 to 16, in particular 10 to 14 carbon atoms.

A cleaner for hard surfaces comprising at least one surfactant and at least one phosphoric acid ester of a polyether-modified alkyl alcohol obtainable by a method comprising the method steps of A) providing at least one branched or linear, saturated or unsaturated alkyl alcohol containing 8 to 20 carbon atoms; B) reacting with, in relation to the at least one alkyl alcohol, 2.2 to 10 mol, of styrene oxide at a temperature from 80 to 150° C. and a pressure from 0.4 to 1.2 bar; C) reacting with, in relation to the at least one alkyl alcohol, 3 to 20 mol of ethylene oxide at a temperature from 80 to 130° C. and a pressure from 0.5 to 6.0 bar; D) reacting with, in relation to the at least one alkyl alcohol, 0 to 10 mol of propylene oxide at a temperature from 80 to 130° C. and a pressure from 0.5 to 6.0 bar; E) reacting with, in relation to the at least one alkyl alcohol, 0 to 10 mol of butylene oxide at a temperature from 80 to 130° C. and a pressure from 0.5 to 6.0 bar; F) reacting with, in relation to the at least one alkyl alcohol, 0.1 to 1.0 mol of polyphosphoric acid $P_4O_{10}$ at a temperature from 50 to 110° C. and a pressure from 0.4 to 1.2 bar, and where appropriate; and H) purifying the obtained phosphoric acid ester.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The object of the present invention is achieved in accordance with the invention by a surfactant-containing cleaner for hard surfaces which comprises as shine additive at least one phosphoric acid ester of a polyether-modified alkyl alcohol or salt thereof in an amount from 0.1 to 3% by weight, wherein the phosphoric acid ester of a polyether-modified alkyl alcohol has the general formula 1:

Formula 1

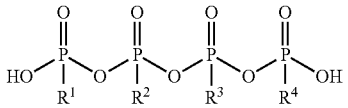

wherein $R^1$, $R^2$, $R^3$ and $R^4$ may be the same or different and are selected from R—O—$(SO)_m$-$(EO)_b$—$(PO)_c$—$(BO)_d$— and —OH, wherein

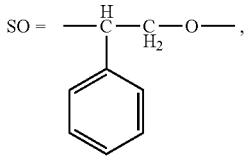

EO=—$CH_2$—$CH_2$—O—

PO=—$CH(CH_3)$—$CH_2$—O— and

BO=—$CH(CH_2CH_3)$—$CH_2$—O— and with the provision that at least one, preferably at least 2, in particular 3, particularly preferably 4, of the groups $R^1$, $R^2$, $R^3$ and $R^4$ are not OH, wherein a=1 to 20, preferably 2.2 to 10, more preferably 2.5 to 7, particularly preferably 3 to 5, b=1 to 100, preferably 3 to 40, more preferably 4 to 15, particularly preferably 8 to 12, c=0 to 10, in particular 0, d=0 to 10, in particular 0, and R is selected from branched or linear, saturated or unsaturated alkyl groups containing 8 to 20 carbon atoms, preferably linear, saturated alkyl groups containing 8 to 16, in particular 10 to 14 carbon atoms.

One advantage of the invention is that the phosphoric acid esters produce a shine effect even when they are comprised in low concentrations in cleaners. A further advantage of the invention is that the cleaners of the invention comprising phosphoric acid esters leave behind neither a smearing or iridescent effect nor a tacky film on the surface. Another advantage of the invention is that the cleaners comprising phosphoric acid esters can also be used with hard water. A further advantage of the invention is that the cleaners comprising the phosphoric acid esters reduce the spotting on surfaces as formulations dry, and the drying times compared to cleaners that do not comprise phosphoric acid esters are not considerably lengthened. Yet a further advantage of the invention is that aqueous cleaners comprising the phosphoric acid esters and surfactants have very good stability.

The cleaner formulations according to the invention, which comprise phosphoric acid esters according to the invention, will be described hereinafter by way of example, without limiting the invention to these exemplary embodiments. Where ranges, general formulas or compound classes are specified hereinafter, these are not intended to include only the corresponding ranges or groups of compounds explicitly mentioned. but also all sub-ranges and sub-groups of compounds that can be obtained by removing individual values (ranges) or compounds. Where compounds, such as polyethers, that may comprise different units repeatedly are described within the scope of the present invention, these units can be distributed randomly (random oligomer) or in an ordered manner (block oligomer) in these compounds. Specifications regarding the number of units in such compounds are to be understood as a mean value, averaged over all corresponding compounds.

Within the scope of the present invention fatty acids or fatty alcohols or derivatives thereof, unless specified otherwise, are representative for branched or unbranched carboxylic acids or alcohols or derivatives thereof containing preferably 6 to 22 carbon atoms. The former are preferred for ecological reasons, in particular on account of their plant base, as they are based on renewable raw materials, however the teaching according to the invention is not limited hereto. In particular, the oxo alcohols obtainable for example by Roelen's oxo synthesis or derivatives thereof can be used accordingly.

Where reference is made hereinafter to alkaline earth metals as counterions for monovalent anions, this means that the alkaline earth metal is present naturally only in half the substance quantity—sufficient for charge equalization—compared with the anion.

Substances that also serve as ingredients of cosmetic agents will be referred to hereinafter where appropriate in accordance with the International Nomenclature Cosmetic Ingredient (INCI) name. Chemical compounds have an INCI name in English, whereas plant ingredients are specified exclusively in Latin using Linnaean classification, and what are known as trivial names, such as "water", "honey" or "sea salt" are also specified in Latin. The INCI names can be inferred from the International Cosmetic Ingredient Dictionary and Handbook—Seventh Edition (1997), which is issued by The Cosmetic, Toiletry, and Fragrance Association (CTFA), 1101 17$^{th}$ Street, NW, Suite 3000, Washington, D.C. 20036, USA and contains more than 9,000 INCI names and also references to more than 37,000 trade names and technical names inclusive of the associated distributors from over 31 countries. The International Cosmetic Ingredient Dictionary and Handbook classifies the ingredients in one or more Chemical Classes, for example Polymeric Ethers, and one or more functions, for example Surfactants—Cleansing Agents, as will be explained in greater detail and to which reference will also be made hereinafter where appropriate.

The specification CAS means that the subsequent sequence of numbers is the name of the Chemical Abstracts Service.

Unless explicitly stated otherwise, specified amounts are in percent by weight (% by weight) in relation to the total agent. Here, these specified percentages relate to active contents.

In various embodiments of the invention preferably 2, more preferably 3, most preferably 4, of the groups $R^1$, $R^2$, $R^3$ and $R^4$ are R—O—$(SO)_a$-$(EO)_b$—$(PO)_c$—$(BO)_d$—. R may be different or the same in the groups $R^1$, $R^2$, $R^3$ and $R^4$.

In accordance with the invention particularly preferred phosphoric acid esters are characterized in that a=2.5 to 5, b=4 to 12 and c=d=0. In further preferred embodiments a=3.0 to 3.3, b=4 to 11, for example 4, 6, 10 or 11, preferably 8 to 11, and c=d=0.

Particularly advantageous phosphoric acid esters according to the invention are characterized in that R is selected from linear, saturated alkyl groups containing 8 to 16, in particular 10 to 14, carbon atoms. R particularly preferably is a mixture of linear, saturated alkyl groups containing 12 and 14 carbon atoms.

Depending on the pH value of the cleaner, the phosphoric acid esters may also be present in partially or completely neutralized form as salts. In particular alkali metal ions and alkaline earth metal ions and also, where appropriate, substituted ammonium ions may be used as counterions in various embodiments.

The phosphoric acid esters comprised in the cleaners according to the invention can be produced by methods known to the person skilled in the art, as are described for example in EP0940406. The phosphoric acid esters according to the invention are preferably produced by the method described hereinafter. The method fundamentally comprises alkoxylation steps. Corresponding instructions for carrying out alkoxylations can be found by the person skilled in the art in DE10054462, WO1992012950 and WO2005026273, for example.

The method for producing phosphoric acid esters suitable for use in the cleaners according to the invention comprises the method steps of A) providing at least one branched or linear, saturated or unsaturated alkyl alcohol containing 8 to 20 carbon atoms or mixtures of a plurality of such alkyl alcohols, B) reacting with, in relation to the at least one alkyl alcohol, 2.2 to 10 mol, preferably 2.5 to 7 mol, particularly preferably 3 to 4 mol, of styrene oxide at a temperature from 80 to 150° C., preferably 100 to 140° C., in particular 110 to 130° C., and a pressure from 0.4 to 1.2 bar, preferably 0.6 to 1 bar, particularly preferably 0.7 to 0.9 bar, C) reacting with, in relation to the at least one alkyl alcohol, 3 to 20 mol, preferably 4 to 15 mol, particularly preferably 8 to 12 mol, of ethylene oxide at a temperature from 80 to 130° C., preferably 100 to 125° C., in particular 110 to 120° C., and a pressure from 0.5 to 6.0 bar, preferably 0.6 to 3.0 bar, particularly preferably 0.8 to 1.5 bar, D) reacting with, in relation to the at least one alkyl alcohol, 0 to 10 mol, preferably 0 mol, of propylene oxide at a temperature from 80 to 130° C., preferably 100 to 125° C., in particular 110 to 120° C., and a pressure from 0.5 to 6.0 bar, preferably 0.6 to 3.0 bar, particularly preferably 0.8 to 1.5 bar, E) reacting with, in relation to the at least one alkyl alcohol, 0 to 10 mol, preferably 0 mol, of butylene oxide at a temperature from 80 to 130° C., preferably 100 to 125° C., in particular 110 to 120° C., and a pressure from 0.5 to 6.0 bar, preferably 0.6 to 3.0 bar, particularly preferably 0.8 to 1.5 bar, F) reacting with, in relation to the at least one alkyl alcohol, 0.1 to 1.0 mol, preferably 0.1 to 0.5 mol, particularly preferably 0.2 to 0.3 mol, of polyphosphoric acid $P_4O_{10}$ at a temperature from 50 to 110° C., preferably 60 to 100° C., in particular 70 to 90° C., and a pressure from 0.4 to 1.2 bar, preferably 0.6 to 1 bar, particularly preferably 0.7 to 0.9 bar, and where appropriate H) purifying the obtained phosphoric acid ester.

Method steps D), E) and H) of the method are optional, this being expressed in method steps D) and E) by the term "reacting with 0 mol" of alkylene oxide.

The alcohol provided in method step A) of the method is preferably selected from linear, saturated primary alkyl alcohols containing 8 to 16, in particular 10 to 14, carbon atoms or mixtures of such alcohols, and the alcohol particularly preferably constitutes a mixture of linear, saturated primary alkyl alcohols containing 12 to 14 carbon atoms.

In method steps B to E of the method the alkoxylation is performed in the presence of catalysts, preferably basic (alkaline) catalysts such as alkali methanolates, sodium hydroxide and/or potassium hydroxide. Sodium methanolate and potassium methanolate are particularly preferred and are preferably used advantageously in catalyst amounts from 0.1 to 5.0% by weight, preferably 0.2 to 0.8% by weight calculated as solid and in relation to the obtained reaction product.

It is advantageous and therefore preferred to carry out the method without water, wherein the term "without water" is to be understood in conjunction with the present invention to mean an amount of less than 0.5% by weight of water in relation to the total reaction batch. It is also advantageous to carry out the method without solvent, therefore without an addition of solvents.

A particularly preferred method is characterized in that in method step B) 3 to 4 mol, and in method step C) 8 to 12 mol, and in method steps D) and E) 0 mol—in each case in relation to the alkyl alcohol—of the respective alkylene oxide are used.

The phosphoric acid esters producible by the method may constitute mixtures of phosphoric acid esters that, besides the above-described phosphoric acid esters of general formula 1, also comprise phosphoric acid esters in which at least one of the P—O—P bonds has been cleaved.

In the cleaners according to the invention the phosphoric acid esters are comprised in an amount from 0.1 to 3% by weight, preferably 0.3 to 0.9% by weight, and particularly preferably approximately 0.6% by weight, in relation to the cleaner ready for use.

Cleaners according to the invention are in particular aqueous formulations, wherein the term "aqueous" is understood to mean a water content of at least 30, preferably 80, and particularly preferably 90% by weight water, in relation to the total formulation.

Besides the phosphoric acid esters, the cleaners according to the invention comprise at least one surfactant, preferably selected from the group consisting of anionic, non-ionic, cationic and amphoteric surfactants and also mixtures thereof.

The surfactants comprised in the cleaner may each be any surfactant that is known for use in cleaners. In a preferred embodiment the at least one surfactant is selected from the group of non-ionic surfactants, anionic surfactants, amphoteric surfactants, cationic surfactants and mixtures thereof.

Non-ionic surfactants within the scope of the invention may be alkoxylates, such as polyglycol ethers, fatty alcohol polyglycol ethers, alkylphenol polyglycol ethers, end group-capped polyglycol ethers, mixed ethers and hydroxy mixed ethers and fatty acid polyglycol esters. Ethylene oxide/propylene oxide block polymers, fatty acid alkanolamides and fatty acid polyglycol ethers can likewise be used. A further important class of non-ionic surfactants that can be used in accordance with the invention is constituted by polyol surfactants and here particularly glycol surfactants, such as alkyl polyglycosides and fatty acid glucamides. Alkyl polyglycosides are particularly preferred, in particular alkyl polyglucosides, wherein the alcohol is particularly preferably a long-chain fatty alcohol or a mixture of long-chain fatty alcohols with branched or unbranched $C_8$ to $C_{18}$ alkyl chains and the degree of oligomerization (DP) of the sugar is between 1 and 10, preferably 1 to 6, in particular 1.1 to 3, extremely preferably 1.1 to 1.7, for example $C_8$-$C_{10}$ alkyl 1.5 glucoside (DP of 1.5). In addition, fatty alcohol ethoxylates (fatty alcohol polyglycol ethers) are also preferred, in particular unbranched or branched, saturated or unsaturated $C_{8-22}$ alcohols alkoxylated with ethylene oxide (EO) and/or propylene oxide (PO) with a degree of alkoxylation of up to 30, preferably ethoxylated $C_{12-22}$ fatty alcohols with a degree of ethoxylation of less than 30, preferably 12 to 28, in particular 20 to 28, particularly preferably 25, for example $C_{16-18}$ fatty alcohol ethoxylates with 25 EO.

Additionally to or independently of the non-ionic surfactant, the cleaner according to the invention may comprise at least one anionic surfactant. Preferred anionic surfactants are here fatty alcohol sulfates, fatty alcohol ether sulfates, dialkyl ether sulfates, monoglyceride sulfates, alkylbenzenesulfonates, olefin sulfonates, alkanesulfonates, ether sulfonates, n-alkyl ether sulfonates, ester sulfonates and lignin sulfonates. Fatty acid cyanamides, sulfosuccinates (sulfosuccinic acid esters), in particular sulfosuccinic acid mono- and di-$C_8$-$C_{18}$-alkyl esters, sulfosuccinamates, sulfosuccinamides, fatty acid isethionates, acylamino alkanesulfonates (fatty acid taurides), fatty acid sarcosinates, ether carboxylic acids and alkyl (ether) phosphates and α-sulfofatty acid salts, acyl glutamates, monoglyceride disulfates and alkyl ethers of glycerol disulfate can likewise be used within the scope of the present invention.

Linear alkylbenzene sulfonates, fatty alcohol sulfates and/or fatty alcohol ether sulfates, in particular fatty alcohol sulfates, are preferred within the scope of the present invention. Fatty alcohol sulfates are products of sulfation reactions on corresponding alcohols, while fatty alcohol ether sulfates are products of sulfation reactions on alkoxylated alcohols. A person skilled in the art will here generally take alkoxylated alcohols to mean the reaction products of alkylene oxide, preferably ethylene oxide, with alcohols, within the context of the present invention preferably with longer-chain alcohols. As a rule, a complex mixture of addition products of different degrees of ethoxylation is obtained from n mol of ethylene oxide and one mol of alcohol, depending on the reaction conditions. A further embodiment of alkoxylation involves the use of mixtures of alkylene oxides, preferably a mixture of ethylene oxide and propylene oxide. Preferred fatty alcohol ether sulfates are the sulfates of low-ethoxylated fatty alcohols with 1 to 4 ethylene oxide units (EO), in particular 1 to 2 EO, for example 1.3 EO. Preferred alkylbenzene sulfonates are in particular those with around 12 C atoms in the alkyl part, for instance linear sodium $C_{10-18}$-alkylbenzenesulfonate. Preferred olefin sulfonates have a carbon chain length of 14 to 16.

The anionic surfactants are preferably used as sodium salts, but may also be present as other alkali metal salts or alkaline earth metal salts, for example magnesium salts, and in the form of ammonium salts or mono-, di-, tri- or tetraalkylammonium salts, in the case of sulfonates also in the form of their corresponding acid, for example dodecylbenzenesulfonic acid.

Besides the previously stated types of surfactants, the agent according to the invention may furthermore also comprise cationic surfactants and/or amphoteric surfactants.

Suitable amphoteric surfactants are for example betaines of the formula $(R^{iii})(R^{iv})(R^{v})N^{+}CH_2COO^{-}$, in which $R^{iii}$ means an alkyl group with 8 to 25, preferably 10 to 21 carbon atoms optionally interrupted by heteroatoms or groups of heteroatoms, and $R^{iv}$ and $R^{v}$ mean identical or different alkyl groups with 1 to 3 carbon atoms, in particular $C_{10}$-$C_{18}$ alkyl dimethyl carboxymethyl betaine and $C_{11}$-$C_{17}$ alkylamidopropyl dimethyl carboxymethyl betaine.

Suitable cationic surfactants are inter alia the quaternary ammonium compounds of formula $(R^{vi})(R^{vii})(R^{viii})(R^{ix})N^{+}X^{-}$; in which $R^{vi}$ and $R^{ix}$ denote four identical or different, in particular two long-chain and two short-chain, alkyl groups and $X^{-}$ denotes an anion, in particular a halide ion, for example didecyldimethylammonium chloride, alkylbenzyldidecylammonium chloride and mixtures thereof. Further suitable cationic surfactants are the quaternary surface-active compounds, in particular with a sulfonium, phosphonium, iodonium or arsonium group, which are also known as antimicrobial active ingredients. The agent can be provided with an anti-microbial effect, or, where applicable, the antimicrobial effect thereof already present on account of other ingredients can be improved, by the use of quaternary surface-active compounds with antimicrobial effect.

The total surfactant content of a—preferably aqueous—cleaner formulation of this type is preferably 0.1 to 40% by weight and particularly preferably 0.1 to 12.0% by weight, in relation to the total formulation.

Further ingredients, which are usually comprised in cleaners for hard surfaces, may also be comprised in the cleaner. This group of further possible ingredients includes, but is not limited to acids, bases, organic solvents, salts, compl agents, fillers, builders, bleaching agents, and mixtures thereof.

Water-Soluble Salts

The cleaner according to the invention may also comprise one or more water-soluble salts in an amount of, in total, 0.1 to 75% by weight. Here, these may be inorganic and/or organic salts.

Here, inorganic salts that can be used in accordance with the invention are preferably selected from the group comprising colorless water-soluble halides, sulfates, sulfites, carbonates, hydrogen carbonates, nitrates, nitrites, phosphates and/or oxides of alkali metals, of alkaline earth metals, of aluminum and/or of the transition metals; ammonium salts can also be used. Here, halides and sulfates of alkali metals are particularly preferred; the at least one inorganic salt is preferably therefore selected from the group comprising sodium chloride, potassium chloride, sodium sulfate, potassium sulfate and mixtures thereof. In a preferred embodiment sodium chloride and/or sodium sulfate is/are used.

The organic salts that can be used in accordance with the invention are, in particular, colorless water-soluble alkali metal salts, alkaline earth metal salts, ammonium salts, aluminum salts and/or transition metal salts of carboxylic acids. The salts are preferably selected from the group comprising formate, acetate, propionate, citrate, malate, tartrate, succinate, malonate, oxalate, lactate and mixtures thereof.

Solvents

In one embodiment the cleaner according to the invention is an aqueous cleaner for hard surfaces. Besides water, it may comprise one or more further water-soluble organic solvents in accordance with a preferred embodiment, usually in an amount from 0 to 15% by weight, preferably 1 to 12% by weight, in particular 3 to 8% by weight.

The solvents, within the scope of the teaching according to the invention, are used as required in particular as a hydrotrope and viscosity regulator. They act in a solubilizing manner in particular for surfactants and electrolyte and perfume and dye, and thus contribute to the incorporation thereof, prevent the formation of liquid-crystalline phases, and contribute to the formation of clear products. The viscosity of the agent according to the invention reduces with increasing solvent quantity. Lastly, the chill haze and clear point of the agent according to the invention decreases with increasing solvent quantity.

Suitable solvents for example are saturated or unsaturated, preferably saturated, branched or unbranched C1-20 hydrocarbons, preferably C2-15 hydrocarbons, with at least one hydroxy group and where appropriate one or more ether functions C—O—C, i.e. oxygen atoms interrupting the carbon atom chain.

Preferred solvents are the—optionally etherified at one end by a C1-6 alkanol—C2-6 alkylene glycols and poly-C2-3-alkylene glycol ethers with on average 1 to 9 of the same or different, preferably the same, alkylene glycol groups per molecule as well as the C1-6 alcohols, preferably ethanol, n-propanol or isopropanol.

Exemplary solvents include the following compounds as named in accordance with INCI: buteth-3, butoxy diglycol, butoxy ethanol, butoxy isopropanol, butoxy propanol, n-butyl alcohol, t-butyl alcohol, butylene glycol, butyl octanol, diethylene glycol, dimethoxy diglycol, dimethyl ether, dipropylene glycol, ethoxy diglycol, ethoxy ethanol, ethyl hexanediol, glycol, hexanediol, 1,2,6-hexanetriol, hexyl alcohol, hexylene glycol, isobutoxypropanol, isopentyldiol, isopropyl alcohol (isopropanol), 3-methoxybutanol, methoxydiglycol, methoxyethanol, methoxyisopropanol, methoxymethyl butanol, methoxy PEG-10, methylal, methyl alcohol, methyl hexyl ether, methylpropanediol, neopentyl glycol, PEG-4, PEG-6, PEG-7, PEG-8, PEG-9, and PEG-6 methyl ether, pentylene glycol, phenoxyethanol, PPG-7, PPG-2-buteth-3, PPG-2 butyl ether, PPG-3 butyl ether and PPG-2 methyl ether, PPG-3 methyl ether, PPG-2 propyl ether, propanediol, propyl alcohol, (n-propanol), propylene glycol, propylene glycol butyl ether, propylene glycol propyl ether, tetradhydrofurfuryl alcohol, and trimethylhexanol.

Longer-chain polyalkylene glycols, in particular polypropylene glycols, are also preferred. Here, PPG-400 or PPG-450 are particularly preferred for example, but polypropylene glycols with longer chain lengths can also be used in the context of this invention.

The solvent is preferably selected from the group comprising ethanol, propanol, isopropanol, ethylene glycol, butyl glycol, propylene glycol, polypropylene glycols and mixtures thereof.

Extremely preferred solvents are the C2 and C3 alcohols, ethanol, n-propanol and/or iso-propanol and also the polyalkylene glycols, particularly polypropylene glycols, in particular PPG-400.

In addition to the previously described solvents, alkanolamines can also be used by way of example as solubilizing agents, in particular for perfume and dyes.

Builders

The cleaner according to the invention may also comprise all builders used conventionally in detergents and cleaners, in particular silicates, carbonates, organic cobuilders and also phosphates.

Silicates include on the one hand crystalline, sheet-like sodium silicates of general formula $NaMSi_xO_{2x+1}.yH_2O$, wherein M is sodium or hydrogen, x is a number from 1.9 to 4 and y is a number from 0 to 20, and preferred values for x are 2, 3 or 4. In addition, amorphous sodium silicates with an $Na_2O:SiO_2$ modulus from 1:2 to 1:3.3, preferably from 1:2 to 1:2.8 and in particular from 1:2 to 1:2.6, can be used, which also include waterglass. Within the scope of this invention the term "amorphous" is also understood to mean "X-ray amorphous". This means that, in X-ray diffraction experiments, the silicates do not afford any sharp X-ray reflections typical of crystalline substances, but rather yield at best one or more maxima of the scattered X-ray radiation, which have a width of several degree units of the diffraction angle. Zeolites can also be used as builder substances, preferably zeolite A and/or P. However, zeolite X and mixtures of A, X and/or P are also suitable.

Both the mono-alkali metal salts and the di-alkali metal salts of carbon dioxide and sesquicarbonates can be comprised in the agents as carbonates. Preferred alkali metal ions are sodium ions and/or potassium ions, and soda (sodium carbonate) and potash (potassium carbonate) are therefore particularly preferred.

Of course, a use of the generally known phosphates as builder substances is also possible, provided a use of this type should not be avoided for ecological reasons. From the plurality of commercially obtainable phosphates, the alkali metal phosphates, particularly preferably pentasodium phosphate or pentapotassium phosphate (sodium tripolyphosphate or potassium tripolyphosphate), have the greatest significance in the detergent and cleaner industry. Here, "alkali metal phosphates" is the collective term for the alkali metal (in particular sodium and potassium) salts of the various phosphoric acids, in which metaphosphoric acids $(HPO_3)_n$ and orthophosphoric acid $H_3PO_4$ can be differentiated among representatives of higher molecular weight. Suitable phosphates are sodium dihydrogen phosphate, $NaH_2PO_4$, disodium hydrogen phosphate (secondary sodium phosphate), $Na_2HPO_4$, trisodium phosphate, tertiary sodium phosphate, $Na_3PO_4$, tetrasodiumdiphosphate (sodium pyrophosphate), $Na_4P_2O_7$, and also the sodium phosphates and potassium phosphates of higher molecular weight created by condensation of $NaH_2PO_4$ and of $KH_2PO_4$, in which case a distinction can be made between cyclic representatives, such as sodium phosphates and potassium metaphosphates, and chain-like types, such as sodium polyphosphates and potassium polyphosphates. In particular in the latter case a plurality of names are used: fused or calcined phosphates, Graham's salt, Kurrol's salt and Maddrell's salt. All higher sodium phosphates and potassium phosphates are referred to jointly as condensed phosphates.

In particular, polycarboxylates/polycarboxylic acids, polymeric polycarboxylates, aspartic acid, polyacetals, dextrins, further organic cobuilders (see below) and phosphonates can be comprised as organic cobuilders.

Usable organic builder substances include, for example the polycarboxylic acids that can be used in the form of their sodium salts, wherein polycarboxylic acids is understood to mean carboxylic acids that carry more than one acid function. By way of example these are citric acid, adipic acid, succinic acid, glutaric acid, malic acid, tartaric acid, maleic acid, fumaric acid, sugar acids, aminocarboxylic acids, nitrilotriacetic acid (NTA), provided such a use is not objectionable for ecological reasons, and mixtures thereof. Preferred salts are the salts of the polycarboxylic acids such as citric acid, adipic acid, succinic acid, glutaric acid, tartaric acid, methylglycinediacetic acid, sugar acids and mixtures thereof. Besides the salts, the acids can also be used per se.

Further polymeric polycarboxylates are suitable as builders; these are, for example, the alkali metal salts of polyacrylic acid or of polymethacrylic acid, for example those having a relative molecular mass from 500 to 70,000 g/mol. The molar masses given for polymeric polycarboxylates are weight-average molar masses $M_w$ of the respective acid form, determined fundamentally by means of gel permeation chromatography (GPC) using a UV detector. The measurement was taken against an external polyacrylic acid standard, which, owing to its structural similarity to the polymers under investigation, provides realistic molecular weight values.

Copolymeric polycarboxylates, in particular those of acrylic acid with methacrylic acid and of acrylic acid or methacrylic acid with maleic acid, are also suitable. Copolymers which have proven to be particularly suitable are those of acrylic acid with maleic acid which comprise from 50 to 90% by weight of acrylic acid and 50 to 10% by weight of maleic acid. Their relative molecular mass, based on free acids, is generally 2,000 to 100,000 g/mol.

To improve the water solubility, the polymers may also comprise alkyl sulfonic acids, such as allyloxybenzenesulfonic acid and methylallylsulfonic acid, as monomer.

Biologically degradable polymers from more than two different monomer units, for example those which contain, as monomers, salts of acrylic acid and of maleic acid as well as vinyl alcohol or vinyl alcohol derivatives, or those which contain, as monomers, salts of acrylic acid and 2-alkylallylsulfonic acid and also sugar derivatives, are also particularly preferred.

Further preferred copolymers comprise, as monomers, preferably acrolein and acrylic acid/acrylic acid salts or acrolein and vinyl acetate.

Further suitable builder substances include polymeric aminodicarboxylic acids, salts thereof or precursor substances thereof, in particular polyaspartic acids or salts and derivatives thereof, which can also be obtained by reacting dialdehydes with polyolcarboxylic acids comprising 5 to 7 C atoms and at least 3 hydroxyl groups, and also dextrins, for example oligomers or polymers of carbohydrates, which can be obtained by partial hydrolysis of starches. These are preferably hydrolysis products with mean molecular masses in the range from 400 to 50,000 g/mol.

Oxydisuccinates and other derivatives of disuccinates, preferably ethylenediamine-N,N'-disuccinate (EDDS), are also further suitable cobuilders, preferably in the form of their sodium salts or magnesium salts, furthermore iminodisuccinates (IDS) and derivatives thereof, for example hydroxy iminodisuccinate (HDIS), and acetylated hydroxycarboxylic acids and salts thereof, which may optionally be present also in lactone form and which comprise at least 4 carbon atoms and at least one hydroxy group and also at most two acid groups.

A further class of substances with cobuilder properties is constituted by the phosphonates. These are, in particular, hydroxyalkanephosphonates and amino alkanephosphonates. Among the hydroxyalkanephosphohates, 1-hydroxyethane-1,1-diphosphonate (HEDP) is of particular importance as cobuilder. It is preferably used as the sodium salt, the disodium salt giving a neutral reaction and the tetrasodium salt giving an alkaline reaction (pH 9). Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, for example as the hexasodium salt of EDTMP or as the heptasodium and octasodium salt of DTPMP. Here, preference is given to using HEDP as builder from the class of phosphonates. In addition, the aminoalkanephosphonates have a marked heavy metal-binding capacity. Accordingly, particularly if the agents also comprise bleaches, it may be preferable to use aminoalkanephosphonates, in particular DTPMP, or mixtures of said phosphonates.

In addition, all compounds able to form complexes with alkaline earth ions can be comprised as cobuilder in the particulate agents.

Acids

To intensify the cleaning performance on lime scale, one or more acids and/or salts thereof can be comprised. The acids are preferably produced from renewable raw materials. In particular, organic acids such as formic acid, acetic acid, citric acid, glycolic acid, lactic acid, succinic acid, adipic acid, malic acid, tartaric acid and gluconic acid as well as mixtures thereof are therefore suitable as acids. In addition, however, the inorganic acids hydrochloric acid, sulfuric acid, phosphoric acid and nitric acid or also amidosulfonic acid or mixtures thereof can also be used. The acids and/or salts thereof selected from the group comprising citric acid, lactic acid, formic acid, salts thereof and mixtures thereof are particularly preferred. They are preferably used in amounts from 0.01 to 10% by weight, particularly preferably 0.2 to 5% by weight.

Bases

Alkalis may also be comprised in the cleaner blocks according to the invention. Those bases selected from the group of alkali metal hydroxides and alkaline earth metal hydroxides and carbonates, especially sodium carbonate or sodium hydroxide, are preferably used in agents according to the invention as bases. In addition, however, ammonia and/or alkanolamines with up to 9 C atoms in the molecule can also be used, preferably the ethanolamines, and especially monoethanolamine Complexing Agents Complexing agents (INCI chelating agents), also known as sequestrants, are ingredients that are capable of complexing and inactivating metal ions so as to prevent their detrimental action on the stability or on the appearance of the cleaners according to the invention, for example turbidity. It is important here on the one hand to complex the calcium ions and magnesium ions in hard water as they are incompatible with numerous ingredients. The complexation of the ions of heavy metals such as iron or copper on the other hand retards the oxidative decomposition of the finished agent. In addition, the complexing agents support the cleaning action.

The following complexing agents named according to INCI are suitable by way of example: aminotrimethylene phosphonic acid, beta-alanine diacetic acid, calcium disodium EDTA, citric acid, cyclodextrin, cyclohexanediamine tetraacetic acid, diammonium citrate, diammonium EDTA, diethylenetriamine pentamethylene phosphonic acid, dipotassium EDTA, disodium azacycloheptane diphosphonate, disodium EDTA, disodium pyrophosphate, EDTA, etidronic acid, galactaric acid, gluconic acid, glucuronic acid, HEDTA, hydroxypropyl cyclodextrin, methyl cyclodextrin, pentapotassium triphosphate, pentasodium aminotrimethylene phosphonate, pentasodium ethylenediamine tetramethylene phosphonate, pentasodium pentetate, pentasodium triphosphate, pentetic acid, phytic acid, potassium citrate, potassium EDTMP, potassium gluconate, potassium polyphosphate, potassium trisphosphonomethylamine oxide, ribonic acid, sodium chitosan methylene phosphonate, sodium citrate, sodium diethylenetriamine pentamethylene phosphonate, sodium dihydroxyethylglycinate, sodium EDTMP, sodium gluceptate, sodium gluconate, sodium glycereth-1 polyphosphate, sodium hexametaphosphate, sodium metaphosphate, sodium metasilicate, sodium phytate, sodium polydimethylglycinophenolsulfonate, sodium trimetaphosphate, TEA-EDTA, TEA-polyphosphate, tetrahydroxyethyl ethylenediamine, tetrahydroxypropyl ethylenediamine, tetrapotassium etidronate, tetrapotassium pyrophosphate, tetrasodium EDTA, tetrasodium etidronate, tetrasodium pyrophosphate, tripotassium EDTA, trisodium dicarboxymethyl alaninate, trisodium EDTA, trisodium HEDTA, trisodium NTA and trisodium phosphate.

Bleaching Agents

Bleaching agents may also be added to the cleaning product in accordance with the invention. Suitable bleaching agents include peroxides, peracids and/or perborates, particularly preferably sodium percarbonate or phthalimidoperoxy-hexanoic acid. Chlorine-containing bleaching agents such as trichloroisocyanuric acid or sodium dichloroisocyanurate, by contrast, are less suitable in the case of acidic cleaners on account of the release of toxic chlorine gas vapors, but can be used in alkaline cleaners. In certain circumstances a bleach activator may also be required in addition to the bleaching agent.

Compounds which, under perhydrolysis conditions, give rise to aliphatic peroxocarboxylic acids containing preferably 1 to 10 C atoms, in particular 2 to 4 C atoms, and/or optionally substituted perbenzoic acid can be used as bleach activators. Of all bleach activators known to a person skilled in the art, polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycoluriles, in particular tetraacetylglycolurile (TAGU), N-acylamides, in particular N-nonanoylsuccinimide (NOSI), acylated phenol sulfonates, in particular n-nonanoyl oxybenzenesulfonate or isononanoyl oxybenzenesulfonate (n-NOBS or iso-NOBS), are particularly preferably used. Combinations of conventional bleach activators may also be used. These bleach activators are preferably used in amounts up to 10% by weight, in particular 0.1% by weight to 8% by weight, particularly 2 to 8% by weight, and particularly preferably 2 to 6% by weight, in each case in relation to the total weight of the agent containing bleach activator.

Auxiliaries and Additives

Besides the previously specified components, the agent according to the invention can comprise one or more further typical—particularly in cleaners for hard surfaces—auxiliaries and additives. These include, for example, organic suspending agents (in particular sugar, sugar alcohols, glycerol, glycols and also polymers thereof), hydrophobicity agents (such as paraffin), UV stabilizers, perfume oils, antimicrobial active ingredients, pearlescent agents (INCI opacifying agents; for example glycol distearate, for example Cutina® from the company BASF, or mixtures containing these, for example Euperlane® from the company BASF), further clouding agents, dyes, corrosion inhibitors, bitters, preservatives (for example 2-bromo-2-nitropropane-1,3-diol (CAS 52-51-7), which is also referred to as Bronopol and which is commercially available for example as Myacide® BT or as Boots Bronopol BT from the company Boots, or also Bronopol-containing mixtures, such as Preventol® (ex Lanxess) or Parmetol® (ex Make & Mayr)), disinfectants, enzymes, pH-adjusting agents, fragrances and skin feel improving or skin-care additives (for example dermatologically effective substances, such as vitamin A, vitamin B2, vitamin B12, vitamin C, vitamin E, D-panthenol, Sericerin, collagen partial hydrolyzate, various vegetable protein partial hydrolyzates, protein hydrolyzate fatty acid condensates, liposomes, cholesterol, vegetable and animal oils such as lecithin, soybean oil, etc., plant extracts such as Aloe Vera, azulene, witch hazel extracts, seaweed extracts, etc., allantoin, AHA complexes, glycerol, urea, quaternized hydroxyethyl cellulose), additives for improving the run-off and drying behavior or for stabilization. These auxiliaries and additives are comprised in particular in amounts of usually not more than 5% by weight.

Fragrances

The product according to the invention may comprise one or more fragrances, preferably in an amount from 0.01 to 10% by weight, in particular 0.05 to 8% by weight, particularly preferably 0.1 to 5% by weight. Here, d-limonene may be comprised as a perfume component. In another embodiment the cleaner block according to the invention here comprises a perfume formed from essential oils. By way of example, pine, citrus, jasmine, patchouli, rose or ylang-ylang oil can be used in the context of this invention. Also suitable are muscatel sage oil, chamomile oil, lavender oil, clove oil, melissa oil, mint oil, cinnamon leaf oil, lime blossom oil, juniper berry oil, vetivert oil, olibanum oil, galbanum oil and laudanum oil and orange blossom oil, neroli oil, orange peel oil and sandalwood oil. Further aromatic substances used typically in detergents and cleaners are suitable equally for use in the cleaner block according to the invention, such as further essential oils, esters, alcohols, aldehydes or terpenes.

Antimicrobial Active Ingredients

Disinfection and sanitation represent a particular aspect of cleaning. In a corresponding, particular embodiment of the invention, the cleaner therefore comprises one or more antimicrobial active ingredients, preferably in an amount from 0.01 to 1% by weight, preferably 0.02 to 0.8% by weight, in particular 0.05 to 0.5% by weight, particularly preferably 0.1 to 0.3% by weight, extremely preferably 0.2% by weight.

In the context of the inventive teaching, the terms disinfection, sanitation, antimicrobial action and antimicrobial active ingredient have the usual technical meaning. Whereas disinfection in the stricter sense of medical practice means the killing of—theoretically all—infectious germs, in sanitation it is understood to mean the greatest possible elimination of all genus—even the saprophytic germs that are normally not harmful to humans. Here the degree of disinfection or sanitation depends on the antimicrobial action of the agent used, which decreases with decreasing content of antimicrobial active ingredient or increasing dilution of the agent used.

Antimicrobial active ingredients suitable in accordance with the invention are selected by way of example from the groups of alcohols, aldehydes, antimicrobial acids or salts thereof, carboxylic acid esters, acid amides, phenols, phenol derivatives, diphenyls, diphenylalkanes, urea derivatives, oxygen acetals and formals, nitrogen acetals and formals, benzamidines, isothiazols and derivatives thereof such as isothiazolines and isothiazolinones, phthalimide derivatives, pyridine derivatives, antimicrobial surface-active compounds, guanidines, antimicrobial amphoteric compounds, quinolines, 1,2-dibromo-2,4-dicyanobutane, iodo-2-propinyl butyl carbamate, iodine, iodophores, compounds that split off active chlorine, and peroxides. Preferred antimicrobial active ingredients are preferably selected from the group comprising ethanol, n-propanol, i-propanol, 1,3-butanediol, phenoxyethanol, 1,2-propylene glycol, glycerol, undecylenic acid, citric acid, lactic acid, benzoic acid, salicylic acid, thymol, 2-benzyl-4-chlorophenol, 2,2'-methylene-bis-(6-bromo-4-chlorophenol), 2,4,4'-trichloro-2'-hydroxydiphenyl ether, N-(4-chlorphenyl)-N-(3,4-dichlorophenyl) urea, N,N'-(1,10-decanediyldi-1-pyridinyl-4-ylidene)bis-(1-octanamine)dihydrochloride, N,N'-bis-(4-chlorophenyl)-3,12-diimino-2,4,11,13-tetraazatetradecanediimidamide, antimicrobial quaternary surface active compounds, guanidine and sodium dichloroisocyanurate (DCI, 1,3-dichloro-5H-1,3,5-triazine-2,4,6-trione sodium salt). Preferred antimicrobially acting surface-active quaternary compounds comprise an ammonium, sulfonium, phosphonium, iodonium or arsonium group. Furthermore, antimicrobially active essential oils can also be employed, which simultaneously perfume the cleaning product. Particularly preferred antimicrobial active ingredients are selected, however, from the group comprising salicylic acid, quaternary surfactants, in particular benzalkonium chloride, peroxy compounds, in particular hydrogen peroxide, alkali metal hypochlorite, sodium dichloroisocyanurate, and mixtures thereof.

Preservatives

Preservatives may also be comprised in cleaner products according to the invention. In essence, the substances cited above as antimicrobial active ingredients may also be used as preservatives.

Dyes

As further ingredients, the cleaner product according to the invention may comprise one or more dyes (INCI colorants). Both water-soluble as well as oil-soluble dyes can be used as dyes, wherein on the one hand the compatibility with further ingredients, for example bleaching agents, should be ensured, and on the other hand the used dye should not have a substantive effect on metal and ceramic, even after long periods of action. The dyes are preferably comprised in an amount from 0.0001 to 0.1% by weight, particularly 0.0005 to 0.05% by weight, and particularly preferably 0.001 to 0.01% by weight.

Corrosion Inhibitors

Suitable corrosion inhibitors (INCI name) for example include the following substances named according to INCI: cyclohexylamine, diammonium phosphate, dilithium oxalate, dimethylamino methylpropanol, dipotassium oxalate, dipotassium phosphate, disodium phosphate, disodium pyrophosphate, disodium tetrapropenyl succinate, hexoxyethyl diethylammonium, phosphate, nitromethane, potassium silicate, sodium aluminate, sodium hexametaphosphate, sodium metasilicate, sodium molybdate, sodium nitrite, sodium oxalate, sodium silicate, stearamidopropyl dimethicone, tetrapotassium pyrophosphate, tetrasodium pyrophosphate, triisopropanolamine.

Flush Regulators

The substances designated as flush regulators act primarily to control the consumption of the agent during use in such a way that the intended lifetime is observed. Solid long-chain fatty acids, such as stearic acid, but also salts of such fatty acids, fatty acid ethanolamides, such as coconut fatty acid monoethanolamide, or solid polyethylene glycols, such as those having molecular weights between 10,000 and 50,000, are preferably suitable as flush regulators.

Enzymes

The cleaning product may also comprise enzymes, for example proteases, lipases, amylases, hydrolases and/or cellulases. The enzymes can be added to the agent according to the invention in any form established according to the prior art. These include solutions of the enzyme, advantageously as concentrated as possible, anhydrous and/or with added stabilizers. Alternatively, the enzymes can be encapsulated, for example by spray drying or extrusion of the enzyme solution together with a preferably natural polymer or in the form of capsules, for example those in which the enzymes are embedded as in a solidified gel, or in those of the core-shell type, in which an enzyme-containing core is coated with a water-, air- and/or chemical-impervious protective layer. Further active ingredients, for example stabilizers, emulsifiers, pigments, bleaching agents or dyes, can additionally be applied in additional layers. Such capsules are applied using methods known per se, for example by vibratory granulation or roll granulation or by fluidized bed processes. Advantageously, these types of granulates, for example by application of polymeric film formers, are dust-free and as a result of the coating are stable under storage.

In addition, enzyme stabilizers can be present in the enzyme-containing cleaning products in order to protect a contained against damage, such as inactivation, denaturing or decomposition for example by physical effects, oxidation or proteolytic cleavage. In each case depending on the enzyme used, the following in particular are suitable as enzyme stabilizers: benzamidine hydrochloride, borax, boric acid, boronic acids or their salts or esters, primarily derivatives comprising aromatic groups, for example substituted phenylboronic acids or their salts or esters; peptide aldehydes (oligopeptides with reduced C-terminus), amino alcohols such as mono, di, triethanolamine and mono, di, tripropanolamine and their mixtures, aliphatic carboxylic acids up to $C_{12}$, such as succinic acid, other dicarboxylic acids or salts of the cited acids, end group-capped fatty acid amide alkoxylates; aliphatic lower alcohols and primarily polyols, for example glycerol, ethylene glycol, propylene glycol or sorbitol, as well as reducing agents and antioxidants such as sodium sulfite and reducing sugars. Further suitable stabilizers are known from the prior art. The use of combinations of stabilizers is preferred, for example the combination of polyols, boric acid and/or borax, the combination of boric acid or borate, reducing salts and succinic acid or other dicarboxylic acids or the combination of boric acid or borate with polyols or polyamino compounds and with reducing salts.

pH Value

The pH value of the agents according to the invention can be set by means of typical pH regulators, for example citric acid or NaOH. Here, the agent preferably has a pH value in a range from 5 to 11.5, preferably 7 to 11.3.

In order to set and/or stabilize the pH value, the agent according to the invention may also comprise one or more buffer substances (INCI buffering agents), usually in amounts from 0.001 to 5% by weight, preferably 0.005 to 3% by weight, in particular 0.01 to 2% by weight, particularly preferably 0.05 to 1% by weight, extremely preferably 0.1 to 0.5% by weight, for example 0.2% by weight. Buffer substances that at the same time are complexing agents or even chelating agents (chelators, INCI chelating agents) are preferred. Particularly preferred buffer substances are citric acid or citrates, in particular sodium citrate and potassium citrate, for example trisodium citrate.2 $H_2O$ and tripotassium citrate.$H_2O$.

The present invention also relates to the use of the cleaner according to the invention for generating shine on a surface, preferably on a hard surface, which particularly preferably is not absorbent. Paper is preferably excluded with the use according to the invention.

The use according to the invention on surfaces is suitable in particular for hard surfaces, such as floors, including tiles, laminates, parquet, cork floors, marble, stone and stoneware floors, and domestic ceramics, such as toilets, wash basins, bidets, shower trays and bathtubs, but also for door handles, fittings, sinks made of ceramic or stainless steel, furniture such as tables, chairs, shelves, work surfaces, windows, cookware, crockery and cutlery.

The present invention also includes a method for generating shine on a surface, preferably on a hard surface, which particularly preferably is not absorbent. The method includes the application of the cleaner of the invention to the surface.

Within the scope of the use according to the invention or the method according to the invention, the cleaner can be applied by pouring/tipping, spraying or otherwise wetting the surface with the liquid cleaner or a solution of the cleaner, preferably in water, when the cleaner is a solid cleaner. The cleaner can be applied for example using a brush, a sponge or a cloth and can then be rubbed in. Following application, excess amounts can be absorbed using a sponge or cloth and the surface can then be dried in the air.

EXAMPLES

Example 1

Shine and Repair Effect on Different Surfaces

The shine and repair effect of 0.6% by weight of a polymer according to formula I with a=3.3, b=10, c=d=0 and R=C12-C14 (polymer A) in a non-ionic and an anionic basic formulation according to table 1 was tested on three different substrates: white tiles, black tiles and laminate. The tiles were damaged by the repeated use of alkaline cleaners or scouring agents (micro-scratches).

TABLE 1

Basic formulations specified amounts of all components are given in % by weight of active substance

| Component | Non-ionic basic formulation | Anionic basic formulation |
|---|---|---|
| C12-C18 fatty alcohol ethoxylate (7EO) | 4.0 | 1.0 |
| Citric acid monohydrate | 0.4 | 0.6 |
| Soda | 0.2 | 0.2 |
| Ethanol | 2.0 | 2.0 |
| Alkylbenzenesulfonate | — | 2.85 |
| Fatty alcohol ethoxylate (5 EO) | — | 1.0 |
| Palm kernel oil fatty acids | — | 0.4 |
| NaOH | — | 0.73 |
| Auxiliaries and additives | 0.08 | 0.78 |
| Water | to 100 | to 100 |
| pH value | 7 | 10 |

The test was performed as follows:

1. 5 mL of the diluted formulation (12 g/l, mains water) were applied to a cloth that was fixed in a frame 2. The cloth was then pressed onto the substrate with a "standard force" and was drawn over the substrate with a constant force 3. The substrate was dried for 1 h 4. Steps 1-3 were repeated five times and then the shine of the substrate was measured using a Dr. Lang reflectometer, REFO60®.

An increase in shine was observed on all substrates, as can be seen from table 2, by addition of the polymer. The change in shine is specified as absolute value. A difference of Δ2 can be seen with the human eye.

TABLE 2

Shine effect (Δ)

| | Non-ionic base | | Anionic base | |
|---|---|---|---|---|
| | Without polymer A | With polymer A | Without polymer A | With polymer A |
| White tiles (damaged) | 3.3 | 7.9 | 7.4 | 18.4 |
| Black tiles (damaged) | 2.9 | 4.4 | 4.8 | 14.5 |
| Laminate | 0.3 | 2.0 | 0.5 | 3.0 |

Example 2

Adsorption of the Polymer and Concentration Dependency thereof a) Laser Reflectometer Hereinafter the chemical adsorption of the polymer A was examined on a test substrate. Here, an oxidized silicon wafer was used as substrate, to which the anionic formulation was applied. The adsorption was measured by means of an in-situ laser reflectometer (University of Wageningen).

TABLE 3

Concentration dependency of the adsorption

| | Anionic base | +0.3% by weight polymer A | +0.6% by weight polymer A | +0.9% by weight polymer A |
|---|---|---|---|---|
| Adsorbed matter (%) | 1.87 | 6.80 | 9.57 | 8.32 |

It was possible to confirm by means of 3 rinsing cycles that the polymer A does not build up further on the surface.

b) Dip Test

A damaged black tile was dipped five times in a diluted formulation (12 g/l, mains water) and the shine values were then measured by means of a Dr. Lang reflectometer, REFO60®, both immediately and after rinsing.

TABLE 4

Adsorption and shine

| | Anionic base with rinsing | Anionic base without rinsing | Anionic base + 0.6% by weight polymer A with rinsing | Anionic base + 0.6% by weight polymer A without rinsing |
|---|---|---|---|---|
| Adsorbed matter (%) | 1.87 | 4.0 | 9.57 | 15.0 |
| Shine change | 1.2 | 2.8 | 3.4 | 5.9 |

Example 3

Shine and Repair Effect a) Repair Effect

Scanning force microscopy images were recorded of the surface of a damaged black tile before and after application five times of the diluted (12 g/l) product (anionic base+0.6% by weight polymer A). The recorded images clearly show the repair effect of the composition according to the invention.

b) Adhesion Minimization by Repair Effect

The adhesion to a tile (damaged or undamaged) before and after the application of the composition according to the invention was also measured in a vertical and a horizontal measurement arrangement.

The results show that, after the treatment with the agent according to the invention, the frictional force on the damaged tile is up to 50% less, which indicates the repair effect of the composition.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A cleaner for hard surfaces, comprising:

a) 0.1 to 3% by weight of at least one phosphoric acid ester of a polyether-modified alkyl alcohol or salt thereof, wherein the phosphoric acid ester of a polyether-modified alkyl alcohol has the general Formula 1:

Formula 1

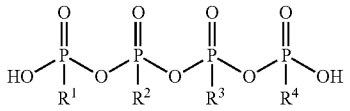

wherein $R^1$, $R^2$, $R^3$ and $R^4$ may be the same or different and are selected from R—O—$(SO)_a$-$(EO)_b$—$(PO)_c$—$(BO)_d$— and —OH, wherein

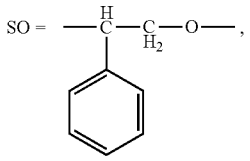

EO=—$CH_2$—$CH_2$—O—,

PO=—$CH(CH_3)$—$CH_2$—O—, and

BO=—$CH(CH_2CH_3)$—$CH_2$—O—, wherein a=1 to 20, b=1 to 100, c=0 to 10, d=0 to 10, and R is selected from branched or linear, saturated or unsaturated alkyl groups containing 8 to 10 carbon atoms with the proviso that at least one of the groups $R^1$, $R^2$, $R^3$ and $R^4$ are not OH; and b) at least one surfactant that is not the at least one phosphoric acid ester of a polyether-modified alkyl alcohol or salt thereof.

2. A cleaner for hard surfaces comprising at least one surfactant and at least one phosphoric acid ester of a polyether-modified alkyl alcohol obtainable by a method comprising the method steps of A) providing at least one branched or linear, saturated or unsaturated alkyl alcohol containing 8 to 20 carbon atoms, B) reacting with, in relation to the at least one alkyl alcohol, 2.2 to 10 mol, of styrene oxide at a temperature from 80 to 150° C. and a pressure from 0.4 to 1.2 bar, C) reacting with, in relation to the at least one alkyl alcohol, 3 to 20 mol of ethylene oxide at a temperature from 80 to 130° C. and a pressure from 0.5 to 6.0 bar, D) reacting with, in relation to the at least one alkyl alcohol, 0 to 10 mol of propylene oxide at a temperature from 80 to 130° C. and a pressure from 0.5 to 6.0 bar, E) reacting with, in relation to the at least one alkyl alcohol, 0 to 10 mol of butylene oxide at a temperature from 80 to 130° C. and a pressure from 0.5 to 6.0 bar, F) reacting with, in relation to the at least one alkyl alcohol, 0.1 to 1.0 mol of polyphosphoric acid $P_4O_{10}$ at a temperature from 50 to 110° C. and a pressure from 0.4 to 1.2 bar, and where appropriate H) purifying the obtained phosphoric acid ester.

3. The cleaner as claimed in claim 1, wherein the agent comprises the at least one phosphoric acid ester of a polyether-modified alkyl alcohol in an amount from 0.3 to 0.9% by weight.

4. The cleaner as claimed in claim 1, wherein the agent comprises the at least one phosphoric acid ester of a polyether-modified alkyl alcohol in an amount approximately 0.6% by weight.

5. The cleaner as claimed in claim 1, wherein the agent is present in solid form.

6. The cleaner as claimed in claim 1, wherein the agent is present in liquid form.

7. The cleaner as claimed in claim 1, wherein the at least one surfactant is selected from the group consisting of: non-ionic surfactants, anionic surfactants, amphoteric surfactants, cationic surfactants, and mixtures thereof.

8. The cleaner as claimed in claim 1, wherein the at least one surfactant is selected from the group consisting of non-ionic, anionic surfactants, and mixtures thereof.

9. The cleaner as claimed in claim 1, wherein further comprising at least component selected from the group consisting of acids, bases, organic solvents, salts, complexing agents, fillers, builders, bleaching agents, bleach activators, auxiliaries and additives, and mixtures thereof.

10. The cleaner as claimed in claim 1, wherein the cleaner is a liquid aqueous cleaner.

11. The cleaner as claimed in claim 1, wherein the cleaner is a cleaner in powder form.

12. The cleaner as claimed in claim 1, wherein the pH value of the cleaner is 5 to 11.5.

13. The cleaner as claimed in claim 1, wherein the pH value of the cleaner is 7 to 11.3.

14. A method for generating shine on a hard surface, comprising applying onto a surface the cleaner of claim 1.

15. The method of claim 14, further comprising rubbing the cleaner on the surface.

* * * * *